United States Patent [19]

Weisz

[11] 3,955,519

[45] May 11, 1976

[54] NEEDLE GUARD FOR SEWING MACHINE

[75] Inventor: William Weisz, Rockaway, N.J.

[73] Assignee: The Singer Company, New York, N.Y.

[22] Filed: June 2, 1975

[21] Appl. No.: 583,148

[52] U.S. Cl. ..... 112/228

[51] Int. Cl.[2] ..... D05B 57/14

[58] Field of Search ..... 112/228, 227, 231, 181, 112/184

[56] References Cited

UNITED STATES PATENTS

| | | | |
|---|---|---|---|
| 2,019,284 | 10/1935 | Wesson | 112/228 |
| 3,023,721 | 3/1962 | Johnson | 112/227 X |
| 3,215,105 | 11/1965 | Kuhar | 112/228 |
| 3,232,258 | 2/1966 | Gegaux | 112/228 |

*Primary Examiner*—H. Hampton Hunter

*Attorney, Agent, or Firm*—Robert E. Smith; Edward L. Bell; Julian Falk

[57] ABSTRACT

This disclosure relates to needle guards for rotary loop takers in sewing machines and has for its purpose prevention of interference between the needle and the loop seizing beak of the rotary loop taker during the sewing operation. A needle guard is provided which is substantially annular and open ended and is resiliently supported within the body of the loop taker. One leg of the needle guard is disposed in the region of the loop seizing beak of the loop taker and in the region of the needle path so that the needle if proceeding toward the loop seizing beak upon penetration of the fabric, will be deflected away from the loop seizing beak and toward the center of the loop taker body. An adjustable anchoring means is provided for the one leg of the needle guard for adjusting the relative position of said one leg relative to the loop seizing beak. The needle guard itself is formed from a resilient wire such that it may be readily snapped in and out of the loop taker body for easy replacement if warranted by unusual wear conditions.

7 Claims, 4 Drawing Figures

NEEDLE GUARD FOR SEWING MACHINE

BACKGROUND OF THE INVENTION

This invention relates to needle guards for sewing machines and more particularly to a device for preventing interference between the needle and the loop seizing beak of the rotary loop taker during the sewing operation. During reciprocation of the needle during sewing, the needle passes in close proximity to the beak of a rotary loop taker and during its return stroke throws out a loop of thread which is seized by the beak of the loop taker for forming the desired stitch. In the event that the needle may become bent or deflected by irregularities in the material and such, the needle may strike the beak of the loop taker and result in a scoring of the beak or a breakage of the needle. It is known in the art to provide needle guards for preventing these occurrences which needle guards are inserted during the assembly of the machine and are adjusted along with the loop taker to provide the proper angular relationship between the hook, the needle guard and the needle. It is also known to provide needle guards which are adjustable after insertion so that its position may be changed relative to the hook position to account for discrepancies between the relationship of the elements during adjustment of the hook relative to the needle. Reference may be made to U.S. Pat. No. 3,215,105 issued Nov. 2, 1965 to Ludwig J. Kuhar.

Although the needle guards of the prior art have operated substantially satisfactorily, they usually require accuracy in machining in their formation and are permanently assembled during the assembly of the sewing machine and are not readily replaceable without substantial disassembly of the machine. In accordance with the present invention accuracy of machining is substantially eliminated and a device is provided which is readily replaceable after assembly. Further, the needle guard of the present invention is relatively easily adjustable relative to the loop seizing beak of the hook as will be apparent hereinafter.

GENERAL DESCRIPTION OF THE INVENTION

The present invention relates to needle guards for rotary loop takers for preventing interference between the needle during reciprocation thereof, and a loop seizing beak of a rotary loop taker. The needle guard of the invention comprises in general a substantially annular open ended resilient element which is supported within the interior of the cup-shaped rotary loop taker in the vicinity of the inner peripheral surface of a side wall of said loop taker. The needle guard is formed slightly larger than the diameter of the inner peripheral surface of the side wall and, being that it is resilient, it may be snapped into the interior of the rotary loop taker and remain there under tension as it tends to expand outwardly. One leg of the needle guard is positioned against an anchoring plug and disposed such that it will deflect the needle away from the loop seizing beak of the rotary loop taker. The other end of the needle guard is anchored into an aperture in the side wall of the rotary loop taker so that it is fixed in position. The anchoring means comprises an adjustable plug member which is supported in an eccentric manner so that it may be turned to deflect the position of the one leg of the needle guard so that its position may be changed to account for changes in the relative position of the line of needle penetration by the needle and a loop seizing beak of the rotary loop taker. It will be apparent that since the needle guard is a resilient wire it may be readily deflected and snapped into the loop taker or out of the loop taker when it is desired to replace the needle guard should it be warranted by unusual wear conditions or the like.

Accordingly, it is one object of the invention to provide a novel and improved needle guard for a rotary loop taker.

It is another object of the invention to provide a novel and improved needle guard for a rotary loop taker which is readily replaceable.

It is a further object of the invention to provide a novel and improved needle guard for a rotary loop taker which does not require accuracy of machining.

It is still another object of the invention to provide a novel and improved needle guard which is easily adjustable.

Other objects and advantages of the invention will be best understood when reading the following detailed description with the accompanying drawings.

DETAILED DESCRIPTION OF THE INVENTION

Figure 1:
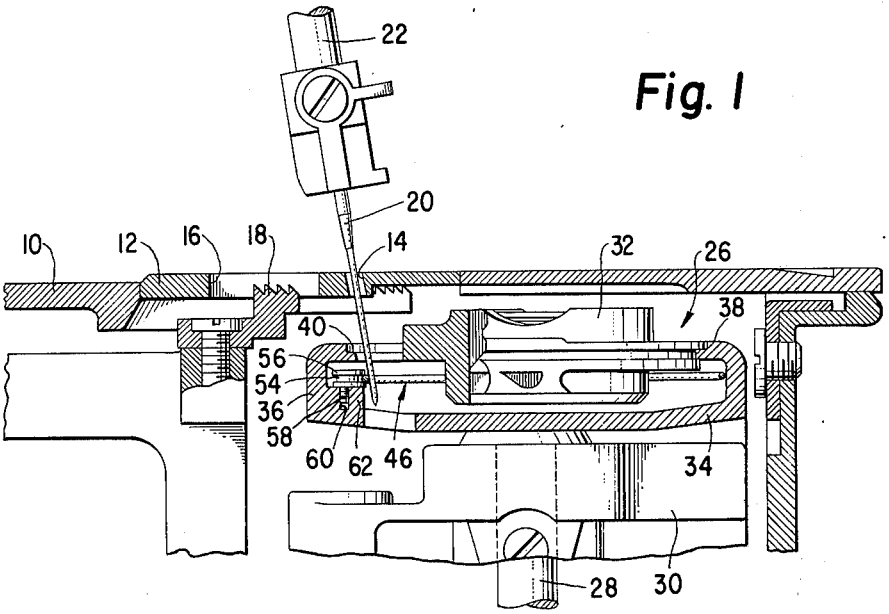
FIG. 1 is a vertical sectional view taken through the base of a lock-stitch sewing machine incorporating the present invention.

Referring to the drawings, in particular FIG. 1, a portion of a sewing machine is shown therein including the sewing elements of the machine and illustrates a base 10 supporting a throat plate 12 which includes a needle aperture 14 and slots 16 for receiving the feed dog 18 for feeding a material across the throat plate 12 in a right to left direction as viewed in said FIG. 1. A needle 20 is suitably supported in a needle bar 22 for endwise reciprocation such that said needle 20 passes through a material and the needle aperture 14 in endwise reciprocation in a known manner. A slide plate 24 is also supported on the base 10 and is removable to permit access to the loop taker 26. The loop taker 26 is supported on a loop taker shaft 28 which shaft 28 is suitably connected to a driving mechanism for rotating the loop taker also in a known manner. The shaft 28 is supported for rotation in a bearing 30 which in turn is suitably supported in the machine frame. A thread carrying case 32 is supported in the loop taker for carrying a supply a thread for cooperation with the needle thread to form a lock stitch as is customary in lock stitch sewing machines. The mechanism thus far described is conventional in sewing machines and reference may be made to U.S. Pat. No. 3,023,721, issued Mar. 6, 1962 for a description of the mechanism thus far described.

Figure 3:
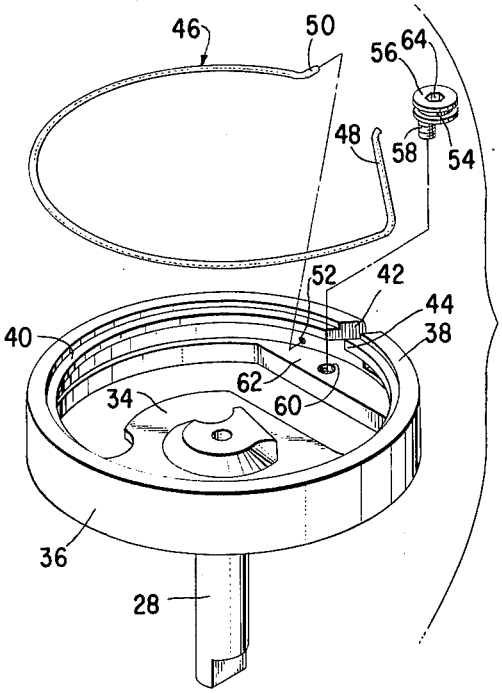
FIG. 3 is an exploded perspective view of the elements shown in FIG. 2.

As further illustrated in the drawings, the loop taker 26 is substantially cup-shaped and comprises a bottom wall 34, a vertically extending side wall 36, and a laterally extending top wall 38 which extends in a direction toward the center of the loop taker 26. As best illustrated in FIG. 3, the top wall 38 is in the form of an annular ring and is provided with an annular rib 40 extending laterally inwardly from the inner peripheral surface thereof. The top wall 38 and rib 40 are provided with a cut-out portion 42 in the form of a narrow channel to form at one end of the annular rib 40 a loop seizing beak 44. The loop seizing beak 44 is located on the loop taker so as to cooperate with the needle 20 during its endwise reciprocation such that the loop seizing beak will seize a loop of thread from the needle and form stitches in a known manner.

As mentioned above, during the sewing operation, due to irregularities in the fabric or because of various conditions which may cause a deflection in the needle, there is a problem that at times the line of needle penetration may be such that the needle will interfere with the loop seizing beak and thus cause damage to the loop seizing beak or the needle. In order to prevent such occurrences a needle guard is provided which needle guard is displaced radially inwardly from the loop seizing beak so as to engage the needle and prevent it from striking the loop seizing beak. Again referring to FIG. 3, a needle guard 46 is illustrated therein which is formed from a resilient wire and is substantially annular in shape but is open ended. A bent leg 48 is shown at one end of the open ended needle guard 46 which bent leg 48 is supported in the loop taker in a manner which will be more fully described hereinafter. The other end or leg 50 of the open ended needle guard is bent in a radially outward direction and when the needle guard is in position in the loop taker the leg 50 is supported in an aperture 52 formed in the side wall 36 of the loop taker 26. Of course it will be understood that other means may be provided for supporting the leg 50 in a fixed relationship. The bent leg 48 of the needle guard 46 is adapted to be anchored in a groove 54 in a cylindrically shaped plug member 56 having a post 58 which post 58 is supported for rotation in an aperture or bore 60 in a shelf 62 provided on the bottom wall 34 of the loop taker 26. The plug 56 is provided with a depression 64 in the top surface thereof which depression may be a slot for receiving a screw driver or a hexagonal opening for receiving a key or the like so that the plug may be rotated about the axis of the supporting post 58 which as illustrated in FIG. 3 is eccentric from the axis of the plug itself.

Figure 2:
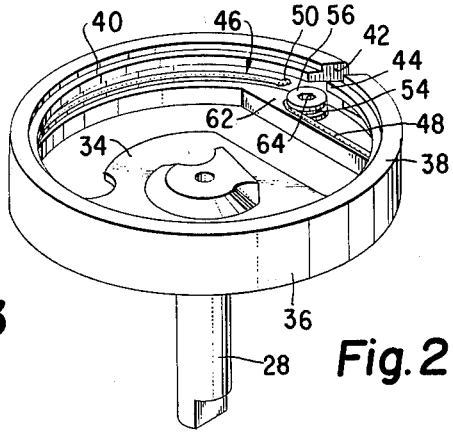
FIG. 2 is a perspective view of the loop taker and needle guard of the invention showing the needle guard in position.
Figure 4:
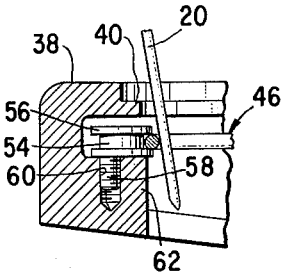
FIG. 4 is an enlarged vertical sectional view of a portion of a loop taker showing the relationship of a needle and needle guard during operation.

As the needle guard 46 is resilient it is preferably formed so that it is slightly larger than the diameter of the inner peripheral surface of the side wall 36 of the loop taker 26 when in a relaxed condition whereby when it is assembled it will bear against the inner peripheral surface of the wall 36 in a springlike fashion. In order to assemble the needle guard 46 in the loop taker 26 the leg 50 of the needle guard is inserted into the aperture 52 in the side wall 36 and the bent leg 48 is rested in the groove 54 in the plug 56 and the needle guard may then be snapped into the loop taker under the bottom surface of the top wall 38 of the loop taker and in bearing relationship with the inner peripheral surface of the side wall 36 of said loop taker. As illustrated in FIG. 2, when the needle guard is in such assembled position, the bent leg 48 of the needle guard extends across the cut-out 42 in the walls 36 and 38 and rib 40 of the loop taker and is adjacent to the loop seizing beak 44. The needle 20 may then be lowered whereupon it may be observed what position the needle takes relative to the needle guard and the loop seizing beak. If during this time it is found that the position of the needle guard is not in proper relationship to the needle and the loop seizing beak, a tool may be inserted into the top portion 64 of the plug 56 and the plug may be rotated about the axis of the post 58 to move the bent leg 48 radially inwardly or outwardly relative to the loop seizing beak and thus properly position the bent leg 48 so as to prevent interference between the needle and the loop seizing beak 44. As discussed above, due to the fact that the plug 56 is eccentrically mounted, rotation about the post 58 will initiate the relative radially inward or outward movement of the bent leg 48. If due to excessive wear of the needle guard, particularly the bent leg 48, it is desired to replace the needle guard, a tool may be inserted between the needle guard and the inner peripheral surface of the side wall 36 of the loop taker and the needle guard due to its resilient character may be snapped out of its supporting aperture 52 and from its anchoring position in the groove 54 of the plug 56 and a new needle guard assembled into position as described above. Adjustments of the new needle guard will be readily provided by simple adjustment of the plug 56 as hereinbefore described.

From the above detailed description it will be apparent that the present invention provides a novel simple and efficient needle guard means for preventing injury to the loop seizing beak and needle of a sewing machine. While the invention has been described in its preferred embodiment, it will be obvious to those skilled in the art that various modifications and changes may be made without departing from the spirit and scope of the invention as defined in the appended claims.

Having thus described the nature of the invention, what is claimed is:

1. A needle guard for a sewing machine loop taker, said loop taker including a cup-shaped body formed by a bottom wall, a vertical side wall extending from said bottom wall and an annular wall extending laterally from the periphery of said side wall, a loop seizing beak formed in said annular wall, and a substantially annular open-ended needle guard disposed within said cup-shaped side body and having one leg thereof disposed adjacent said loop seizing beak for deflecting a needle away from said loop seizing beak and toward the center of the loop taker body.

2. A needle guard as recited in claim 1 further comprising an adjustable anchoring plug supported by said loop taker body and disposed for receiving and anchoring said one leg of said needle guard.

3. A needle guard as recited in claim 2 wherein said anchoring plug is adjustable for changing the position of said one leg of said needle guard relative to said loop seizing beak.

4. A needle guard as recited in claim 3 wherein said anchoring plug is provided with a post for pivotably supporting said anchoring plug in said loop taker body, said post being disposed in an offset relationship with respect to the axis of said plug such that upon rotation of said plug said one leg of said needle guard will be displaced relative to said loop seizing beak.

5. A needle guard as recited in claim 1 wherein said needle guard is formed from a resilient wire, and said needle guard being relatively larger in diameter in a relaxed condition than the inner periphery of said side wall such that said needle guard exerts a spring force aginst the inner periphery of said side wall.

6. A needle guard as recited in claim 5 wherein said one leg of said needle guard is anchored by an anchoring plug, said anchoring plug being adjustable for changing the position of said one leg relative to said loop seizing beak, and the other leg of said needle guard being anchored by a retaining means in said loop taker body.

7. A needle guard as recited in claim 5 wherein said needle guard is capable of being snapped in and out of said loop taker body.

* * * * *